US006960734B1

(12) United States Patent
Park

(10) Patent No.: US 6,960,734 B1
(45) Date of Patent: Nov. 1, 2005

(54) BUTTON MOUNTING STRUCTURE FOR CAR AUDIO SYSTEMS

(75) Inventor: Ju-Hwan Park, Kyunggi-do (KR)

(73) Assignee: Hyundai Mobis Co., Ltd., Yongin-shi (KR)

( * ) Notice: Subject to any disclaimer, the term of this patent is extended or adjusted under 35 U.S.C. 154(b) by 0 days.

(21) Appl. No.: 11/028,590

(22) Filed: Jan. 5, 2005

(30) Foreign Application Priority Data

Sep. 6, 2004 (KR) ..... 10-2004-0070742

(51) Int. Cl.[7] ..... H01H 13/00
(52) U.S. Cl. ..... 200/343; 200/296
(58) Field of Search ..... 200/5 R, 5 A, 200/296, 341–345

(56) References Cited

U.S. PATENT DOCUMENTS 5,003,133 A * 3/1991 Kobayashi et al. ..... 200/5 A
5,788,060 A * 8/1998 Kuroda ..... 200/343
5,813,520 A * 9/1998 Reier et al. ..... 200/343
5,927,483 A * 7/1999 Yamada ..... 200/343
5,990,432 A * 11/1999 Kuroda ..... 200/343

* cited by examiner

*Primary Examiner*—Michael A. Friedhofer
(74) *Attorney, Agent, or Firm*—Greenblum & Bernstein, P.L.C.

(57) ABSTRACT

A button mounting structure for a car audio system includes a button including a pushing unit having a pushing part which protrudes forward, a locking piece provided above the pushing unit to be spaced apart from the pushing unit by a predetermined interval with first locking recesses provided on both sides of the locking piece, and connecting parts to connect the pushing unit to the locking piece. The structure further includes a front panel having an opening into which the pushing part is inserted, with first locking protrusions provided on opposite sides of the front panel, each of the first locking protrusions comprising an upper thin plate to cover an upper surface of opposite sides of the locking piece, a lower thin plate to cover a lower surface of the opposite sides of the locking piece, and a fitting rib provided between the upper and lower thin plates to engage with an associated first locking recess.

4 Claims, 2 Drawing Sheets

[FIG. 1] PRIOR ART
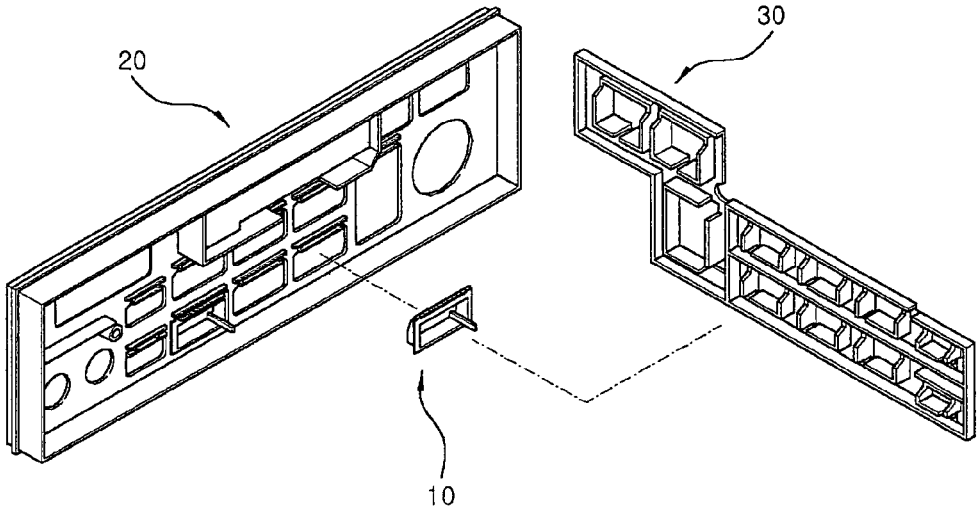
[FIG. 2] PRIOR ART
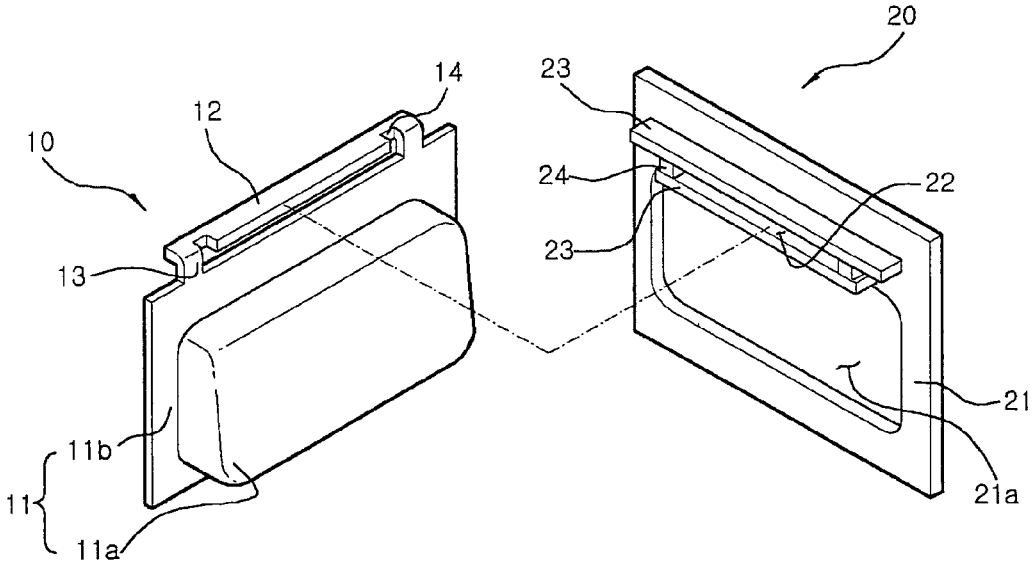

[FIG. 3]
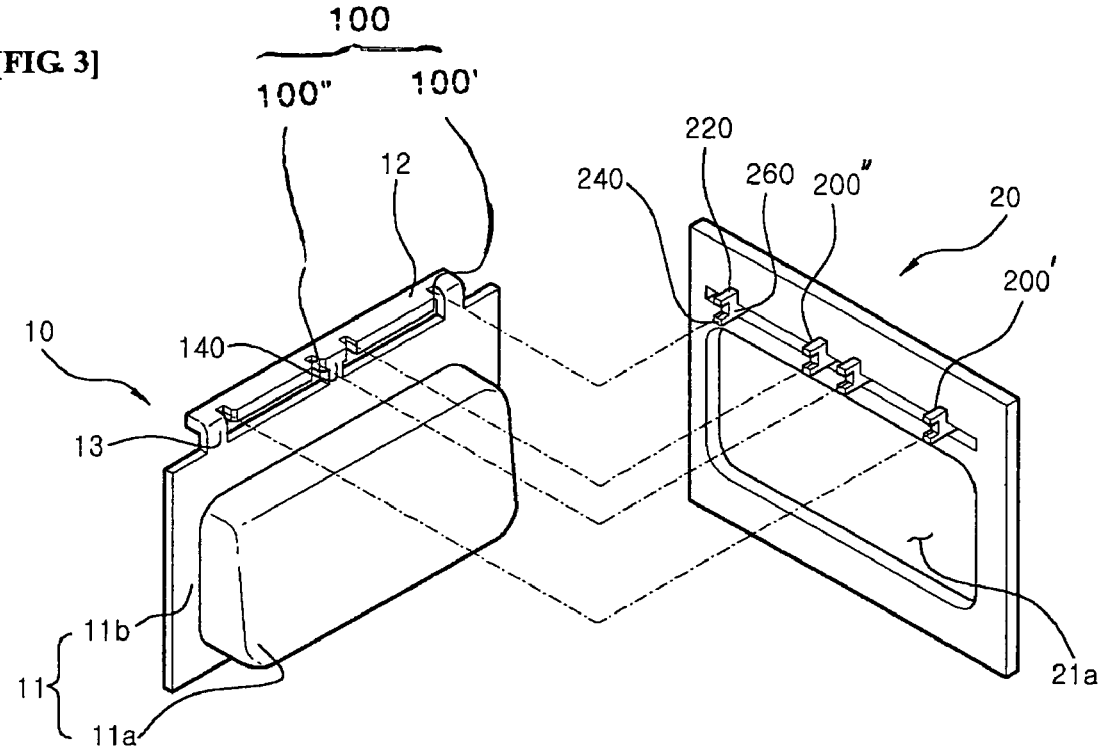
[FIG. 4]
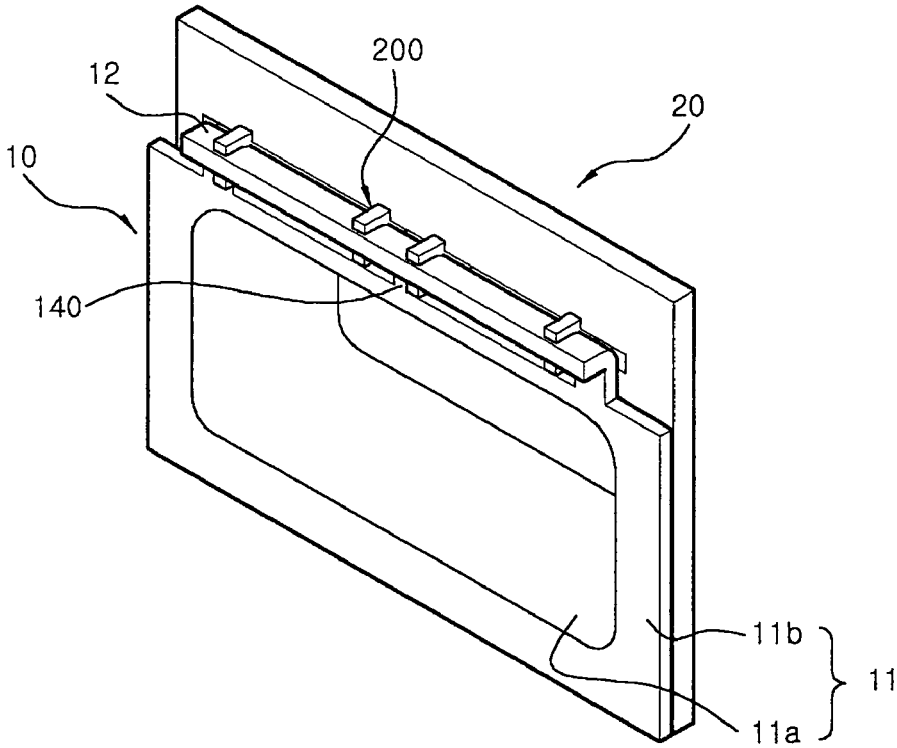

BUTTON MOUNTING STRUCTURE FOR CAR AUDIO SYSTEMS

RELATED APPLICATIONS

The present disclosure relates to subject matter contained in priority Korean Application No. 10-2004-0070742, filed on Sep. 6, 2004, which is herein expressly incorporated by reference in its entirety.

BACKGROUND OF THE INVENTION

1. Field of the Invention

The present invention relates generally to button mounting structures for car audio systems and, more particularly, to a button mounting structure for car audio systems, which is configured so that a locking protrusion of a front panel engages with a locking recess of a button to prevent undesirable movement of the button, thus being involved in only the function of preventing the undesirable movement of the button without participating in the operation of the button, therefore improving the impression quality of the car audio systems.

2. Description of the Related Art

Generally, a plurality of buttons for selecting a mode of a car audio system and controlling a function of the car audio system, including a volume knob that controls a volume of the car audio system, is provided on a front panel which is mounted to the front of the car audio system.

When the buttons provided on the front panel are pushed by a pushing force, the mode of the car audio system is selected or the function of the car audio system is controlled. Further, after the mode has been selected or a predetermined function has been controlled, the pushing force is released. Thereby, the mode selection or the function control of the car audio system is completed.

A conventional button mounting structure for car audio systems is shown in FIGS. 1 and 2.

FIG. 1 is an exploded perspective view to show the conventional button mounting structure for car audio systems, and FIG. 2 is an enlarged exploded perspective view of the button mounting structure of FIG. 1.

As shown in FIGS. 1 and 2, the conventional button mounting structure for car audio systems includes a button 10 and a front panel 20. The button 10 includes a pushing unit 11, a locking piece 12, and connecting parts 13. The pushing unit 11 has a pushing part 11*a* which protrudes forwards and a frame 11*b* which is provided behind the pushing part 11*a* to extend outward from the pushing part 11*a* The locking piece 12 is provided above the pushing unit 11 and is spaced apart from the pushing unit 11 by a predetermined interval, with locking recesses 14 formed on both sides of the locking piece 12. The connecting parts 13 serve to connect the locking piece 12 to the pushing unit 11. Further, the front panel 20 includes an opening 21*a*, support plates 23, and fitting ribs 24. The opening 21*a* accommodates the pushing part 11*a* therein. The support plates 23 function to support upper and lower surfaces of the locking piece 12. The fitting ribs 24 are provided between the support plates 23.

In such a construction, the fitting ribs 24 are provided between the support plates 23, thus defining a locking groove 22. The locking piece 12 is fitted into the locking groove 22 to be held in the locking groove 22. A housing 30 is mounted to a rear surface of the button 10 to support the button 10.

In this case, when the button 10 is combined with the front panel 20, an insert depth of the button 10 is limited by the recesses 14.

In order to enhance the impression quality of the car audio system when the button is pushed to operate the car audio system, the button must be designed not to undesirably move from a predetermined position. According to the conventional button mounting structure for the car audio system, the length and width of the locking piece of the button or the length and width of the locking groove of the front panel are adjusted to prevent the undesirable movement of the button. In other words, a gap between the button and a button holding structure of the front panel is adjusted to prevent undesirable movement of the button. However, such a method is problematic in that much experience and know-how are required.

Further, it is very difficult to adjust the gap between the locking piece of the button and the locking groove engaging with the locking piece.

In the conventional button, a hinge point, horizontal movement, and depth of recesses of the locking piece must be controlled. As such, since the locking piece has many functions and therefore many design considerations, maintenance and design of the button and the front panel are difficult.

SUMMARY OF THE INVENTION

Accordingly, the present invention has been made keeping in mind the above problems occurring in the prior art, and an object of the present invention is to provide a button mounting structure for car audio systems, which allows a locking protrusion of a front panel and a locking recess of a button to have only a function of preventing undesirable movement of the button, thus enhancing the impression quality of the car audio systems.

Another object of the present invention is to provide a button mounting structure for car audio systems, which further includes a second locking protrusion and a second locking recess corresponding to the second locking protrusion, thus more efficiently preventing undesirable movement of the button.

In order to accomplish the above object, the present invention provides a button mounting structure for a car audio system, including a button including a pushing unit having a pushing part which protrudes forwards, a locking piece provided above the pushing unit to be spaced apart from the pushing unit by a predetermined interval with first locking recesses provided on both sides of the locking piece, and connecting parts to connect the pushing unit to the locking piece, a front panel having an opening into which the pushing part is inserted, with first locking protrusions provided on opposite sides of the front panel, each of the first locking protrusions including an upper thin plate to cover an upper surface of opposite sides of the locking piece, a lower thin plate to cover a lower surface of the opposite sides of the locking piece, and a fitting rib provided between the upper and lower thin plates to engage with an associated first locking recess.

According to such a construction, the locking protrusions and the locking recesses serve merely to prevent undesirable movement of the button, and the connecting parts serve as a hinge. Further, a housing is mounted to a rear surface of the button, thus holding a hinge point of the button, that is, the connecting parts, and preventing undesirable movement of the button. Thus, a function of the locking piece of this invention is simple, compared to the conventional locking piece, so that the design and maintenance of the button and the front panel are simple. Further, the locking protrusions and the locking recesses serve merely to prevent undesirable movement of the button without participating in the operation of the button, thus enhancing the impression quality of the car audio systems.

Further, a die structure for the button mounting structure is simple, thus enhancing productivity and ease of assembly. The simple die structure allows mass production to be easily performed without any problem related to injection molding.

The button mounting structure further includes a subsidiary hinge which is provided at a predetermined position between the connecting parts and couples the locking piece to the pushing unit.

Furthermore, a second locking recess is provided between the first locking recesses, and a second locking protrusion is provided on the front panel to engage with the second locking recess, thus more efficiently preventing undesirable movement of the button.

BRIEF DESCRIPTION OF THE DRAWINGS

The above and other objects, features and advantages of the present invention will be more clearly understood from the following detailed description taken in conjunction with the accompanying drawings, in which:

FIG. 1 is an exploded perspective view to show a conventional button mounting structure for car audio systems;

FIG. 2 is an enlarged exploded perspective view to show the button mounting structure of FIG. 1;

FIG. 3 is an enlarged exploded perspective view to show a button mounting structure for car audio systems, according to the preferred embodiment of the present invention; and FIG. 4 is a perspective view of the button mounting structure of FIG. 3, when a button and a front panel of the button mounting structure are assembled together.

DESCRIPTION OF THE PREFERRED EMBODIMENTS

Hereinafter, the preferred embodiment of the present invention will be described with reference to the accompanying drawings. The construction common to both the prior art and the present invention will not be described below, but construction specific to the present invention will be described in detail.

FIG. 3 is an enlarged exploded perspective view to illustrate a button mounting structure for car audio systems, according to the preferred embodiment of the present invention, and FIG. 4 is a perspective view of the button mounting structure of FIG. 3, when a button and a front panel of the button mounting structure are assembled together.

As shown in FIGS. 3 and 4, the button mounting structure for the car audio system according to the preferred embodiment of this invention includes a button 10 and a front panel 20. The button 10 includes a pushing unit 11, a locking piece 12, and connecting parts 13. The pushing unit 11 has a pushing part 11*a* which protrudes forwards. The locking piece 12 is provided above the pushing unit 11 to be spaced apart from the pushing unit 11 by a predetermined interval. The connecting parts 13 couple the pushing unit 11 to the locking piece 12. Further, the front panel 20 includes an opening 21*a* into which the pushing part 11*a* is inserted.

Similar to the prior art, it is preferable that the pushing unit 11 have a frame 11*b* behind the pushing part 11*a*.

A plurality of locking recesses 100 is provided on the locking piece 12.

The locking recesses 100 comprise first locking recesses 100' which are provided on both sides of the locking piece 12, and second locking recesses 100" which are provided between the first locking recesses 100'.

Preferably, the second locking recesses 100" are located to be symmetrical around the center of the locking piece 12.

Further, it is preferable that a subsidiary hinge 140 be provided to connect the pushing unit 11 to a part of the locking piece 12 and is positioned between the second locking recesses 100".

In this case, it is preferable that each of the first locking recesses 100' have the same size and shape as each of the second locking recesses 100". The first locking recesses 100' perform the same function as the second locking recesses 100".

A plurality of locking protrusions 200 is provided on the front panel 20. While the locking protrusions 200 engage with the corresponding locking recesses 100, the locking protrusions 200 are locked to the locking piece 12.

The locking protrusions 200 comprise first locking protrusions 200' and second locking protrusions 200". The first locking protrusions 200' are provided on both sides of the front panel 20 to engage with the first locking recesses 100'. The second locking protrusions 200" are provided between the first locking protrusions 200' to engage with the second locking recesses 100".

It is preferable that each of the first locking protrusions 200' have the same size and shape as each of the second locking protrusions 200". The first locking protrusions 200' perform the same function as the second locking protrusions 200".

Each of the locking protrusions 200 includes an upper thin plate 220 to cover an upper surface of each of both sides of the locking piece 12, a lower thin plate 240 to cover a lower surface of each of both sides of the locking piece 12, and a fitting rib 260 which is provided between the upper and lower thin plates 220 and 240 to be seated in each of the locking recesses 100.

In this case, it is preferable that the width of each of the locking protrusions 200 be equal to the width of each of the locking recesses 100.

Further, the upper thin plate 220, the lower thin plate 240, and the fitting rib 260 of each of the locking protrusions 200 are integrated with each other into a single structure, so that the locking protrusion 200 has a U-shaped recess.

Due to such a construction, when the button 10 is assembled with the front panel 20, the recess of each locking protrusion 200 comes into contact with an associated locking recess 100, so that the locking protrusion 200 is perpendicularly combined with the locking piece 12 in a cross shape.

Therefore, the locking piece 12 engages with the recess of each locking protrusion 200, thus preventing vertical movement of the button 10. Further, each locking protrusion 200 engages with an associated locking recess 100 of the locking piece 12, thus preventing horizontal movement of the button 10. Further, the locking protrusions 200 and the locking recesses 100 function to merely prevent undesirable movement of the button 10, whereas the connecting parts 13 and the subsidiary hinge 140 function as a hinge of the button.

As such, while the button 10 is combined with the front panel 20, a housing 30 is mounted to a rear surface of the button 10. In this case, the housing 30 holds the connecting parts 13 and the subsidiary hinge 140 that serve as the hinge of the button 10, thus preventing undesirable movement of the button 10.

The operation of the present invention constructed as described above will be described below.

When the button 10 is pushed by a pushing force, the locking recesses 100 of the button 10 and the locking protrusions 200 of the front panel 20 serve merely to prevent horizontal and vertical movement of the button 10, and the connecting parts 13 and the subsidiary hinge 140 serve as the hinge of the button 10.

The locking protrusions 200 and the locking recesses 100 serve to merely prevent undesirable movement of the button 10 without participating in the operation of the button 10, thus enhancing the impression quality of car audio systems. Further, the locking protrusions 200 and the locking recesses 100 serve only to engage with each other so as to prevent undesirable movement of the button 10. Furthermore, since the function of the locking piece 12 is simple compared to the locking piece of the prior art, the design and maintenance of the button 10 and the front panel 20 are easy.

Further, because a die structure for the button mounting structure of this invention is simple, productivity and ease of assembly are enhanced. The simple die structure also allows mass production to be easily performed without any problem related to injection molding.

According to the present invention, the subsidiary hinge 140 is provided between the connecting parts 13, and connects the locking piece 12 to the pushing unit 11. Further, the second locking recesses 100" are provided on both sides of the locking piece 12 to be positioned on opposite sides of the subsidiary hinge 140. Furthermore, the second locking recesses 200" are provided on the front panel 20 to engage with the corresponding second locking recesses 100". Such a construction more efficiently prevents undesirable movement of the button 10.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

As described above, a button mounting structure for car audio systems according to the present invention has the following effects.

According to the present invention, a plurality of locking recesses is provided on a locking piece, and a plurality of locking protrusions is provided on a front panel. Each of the locking protrusions includes an upper thin plate to cover an upper surface of opposite sides of the locking piece, a lower thin plate to cover a lower surface of the opposite sides of the locking piece, and a fitting rib provided between the upper and lower thin plates to engage with an associated locking recess. The locking protrusions and the locking recesses serve merely to prevent undesirable movement of the button without participating in the operation of the button, thus enhancing the impression quality of car audio systems. Further, the present invention allows a manufacturer to consider only a combining structure for preventing undesirable movement of the button. Further, a function of the locking piece of this invention is simple, compared to a conventional locking piece, so that the maintenance and design of the button and the front panel are easy.

Moreover, a die structure for the button mounting structure is simple, thus increasing productivity and ease of assembly. The simple die structure also allows mass production to be easily performed without any problem related to the injection molding.

Further, a subsidiary hinge is provided between connecting parts to connect the locking piece to a pushing unit, and second locking recesses are provided on both sides of the locking piece to be positioned on opposite sides of the subsidiary hinge, and second locking protrusions are provided on the front panel to engage with the second locking recesses. Such a construction more efficiently prevents undesirable movement of the button.

What is claimed is:

1. A button mounting structure for a car audio system, comprising:

a button comprising a pushing unit having a pushing part which protrudes forward, a locking piece provided above the pushing unit to be spaced apart from the pushing unit by a predetermined interval with first locking recesses provided on both sides of the locking piece;

connecting parts to connect the pushing unit to the locking piece; and a front panel having an opening into which the pushing part is inserted, with first locking protrusions provided on opposite sides of the front panel, each of the first locking protrusions comprising an upper thin plate to cover an upper surface of opposite sides of the locking piece, a lower thin plate to cover a lower surface of the opposite sides of the locking piece, and a fitting rib provided between the upper and lower thin plates to engage with an associated first locking recess.

2. The button mounting structure as set forth in claim 1, further comprising:

a subsidiary hinge provided at a predetermined position between the connecting parts to connect the locking piece to the pushing unit.

3. The button mounting structure as set forth in claim 2, further comprising:

a second locking recess provided at a predetermined position between the first locking recesses; and a second locking protrusion provided on the front panel to engage with the second locking recess.

4. The button mounting structure as set forth in claim 1, further comprising:

a second locking recess provided at a predetermined position between the first locking recesses; and a second locking protrusion provided on the front panel to engage with the second locking recess.

* * * * *